United States Patent [19]

Katusha et al.

[11] 4,062,385

[45] Dec. 13, 1977

[54] TONER HANDLING APPARATUS

[75] Inventors: Jerome Mark Katusha, Saratoga, Calif.; Stephen James Flamini, Rochester, N.Y.

[73] Assignee: Eastman Kodak Company, Rochester, N.Y.

[21] Appl. No.: 558,522

[22] Filed: Mar. 14, 1975

[51] Int. Cl.[2] ..... B65D 1/06; B65D 43/02

[52] U.S. Cl. ..... 141/89; 141/364; 222/325; 222/544; 222/DIG. 1; 206/816; 214/304; 220/359

[58] Field of Search ..... 222/325, DIG. 1, 544; 206/526, 816, 498; 220/350, 359; 229/7 R; 214/304; 141/363, 364, 365, 366, 89

[56] References Cited

U.S. PATENT DOCUMENTS

| | | | |
|---|---|---|---|
| 2,431,786 | 12/1947 | Williamson | 222/541 X |
| 3,339,807 | 9/1957 | Eichorn | 222/DIG. 1 |
| 3,501,065 | 3/1970 | Altmann et al. | 222/392 |
| 3,539,077 | 11/1970 | Drexler | 222/82 |
| 3,999,654 | 12/1976 | Pollack | 222/542 X |

FOREIGN PATENT DOCUMENTS

| | | | |
|---|---|---|---|
| 322,367 | 4/1970 | Sweden | 222/325 |

*Primary Examiner*—Robert B. Reeves
*Assistant Examiner*—Frederick R. Handren
*Attorney, Agent, or Firm*—Raymond L. Owens

[57] ABSTRACT

A storage unit is disclosed for transferring toner from the storage unit to a toner receiving receptacle in an electrophotographic apparatus without exposing the operator to contact with the toner. The storage unit includes a toner container; a removable tear strip which seals an opening in the container; and a slidable cover which protects the tear strip during storage, wipes toner from the tear strip as it is removed, and reseals the opening in the container after transfer of toner to a receiving receptacle in an electrophotographic apparatus.

3 Claims, 5 Drawing Figures

TONER HANDLING APPARATUS

BACKGROUND OF THE INVENTION

1. Field of the Invention

The present invention relates generally to toner handling device usable to replenish the toner in an electrophotographic apparatus. More specifically, this invention relates to a toner storage unit and toner receptacle in an electrophotographic apparatus which cooperate to empty the toner from the unit into receptacle without exposing an operator to possible contact with the toner.

2. Description of the Prior Art

In electrophotographic copiers, it is common to use a toner powder to develop an electrostatic latent image formed on a photoconductive web or belt. The latent image is dusted or brushed with powder particles, which are selectively attracted to electrostatically charged areas on the web or plate to form a visible powder particle image of the latent image. When toner powder is depleted, it is necessary to periodically replenish the electrophotographic apparatus with a fresh supply of toner. However, common commercial toner powders present considerable difficulty in handling, both because they blacken everything they touch and because they are extremely difficult to thoroughly empty from a toner container.

Disposable toner containers in commercial use generally are opened by an operator and their contents emptied into a toner dispensing mechanism in the electrophotographic apparatus. Emptying of the toner powder from the toner container into the dispensing mechanism by hand, without excessive blackening of person and clothing, is a delicate operation in which failure is common.

SUMMARY OF THE INVENTION

These and other problems are solved, in accordance with the present invention, by a toner storage unit which cooperates with its receptacle in an electrophotographic apparatus to insure that any surface of the unit, subject to contact by the toner inside the unit, is wiped clean before handling by an operator.

In a preferred embodiment of the instant invention, the toner storage unit has a housing or container which defines a chamber for holding the toner powder. A tear strip, located on the housing, has a surface portion subject to contact by the toner particles inside the chamber and is separable from the housing to allow the toner to empty through an opening in the container. A cover member of the storage unit engages the housing to cover the opening after the chamber is emptied of the toner powder. The cover includes a wiper, such as a resiliently compressible pad, for wiping any toner powder from the surface portion of the tear strip as the tear strip is separated from the housing. As the toner powder is emptied from the chamber, the housing is seated on a toner receiving receptacle in the electrophotographic apparatus. The housing, and the cover with the wiper, are supported by the receptacle in relative fixed positions. This enables the surface of the tear strip carrying toner to move in contact with the wiper as the tear strip is separated from the housing. With this arrangement, the surface of the tear strip is wiped clean of any toner powder before it can be touched by an operator. Besides serving as a wiper, the compressible pad affirmatively seals the exit opening (after the tear strip is removed) when the cover is re-engaged with the housing.

BRIEF DESCRIPTION OF THE DRAWINGS

For more complete understanding of the instant invention, as well as the advantages and features thereof, reference should be had to the following detailed description of the invention taken in conjunction with the accompanying drawings, in which.

DESCRIPTION OF THE PREFERRED EMBODIMENT

Figure 1:
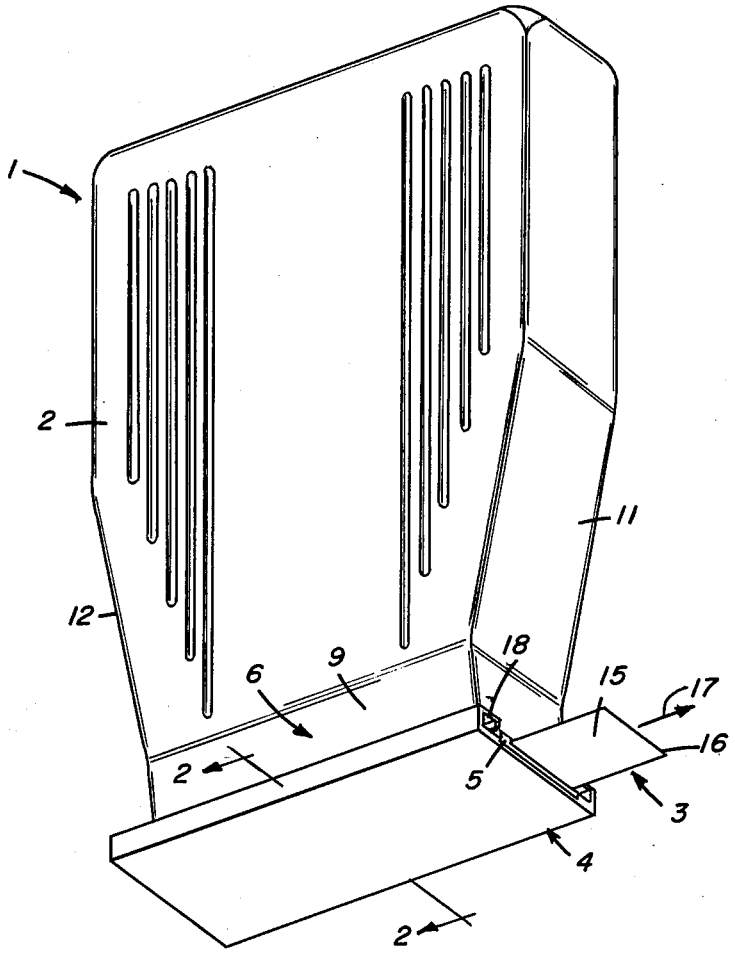
FIG. 1 is a perspective view of the toner container according to a preferred embodiment of the instant invention.
Figure 2:
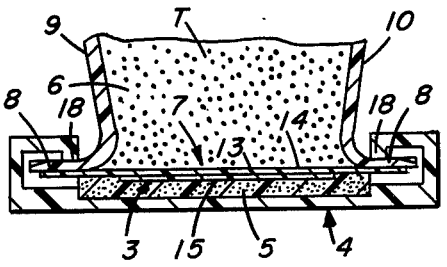
FIG. 2 is a front elevation view, in partial section, of the toner container as viewed along the line 2—2 in FIG. 1.

Referring now to the drawings, and in particular to FIGS. 1 and 2, there is shown a toner storage unit generally designated by the reference numeral 1. In substance, such unit 1 is an assembly of four pieces; a housing or hollow container 2 defining a chamber in which is contained a toner powder T; a tear strip 3 which, before its removal from the housing, prevents the toner powder from leaking out of the housing; a slide-on cover or closure 4 engageable with the housing; and a wiper-seal 5 attached to the inside of the cover.

Figure 3:
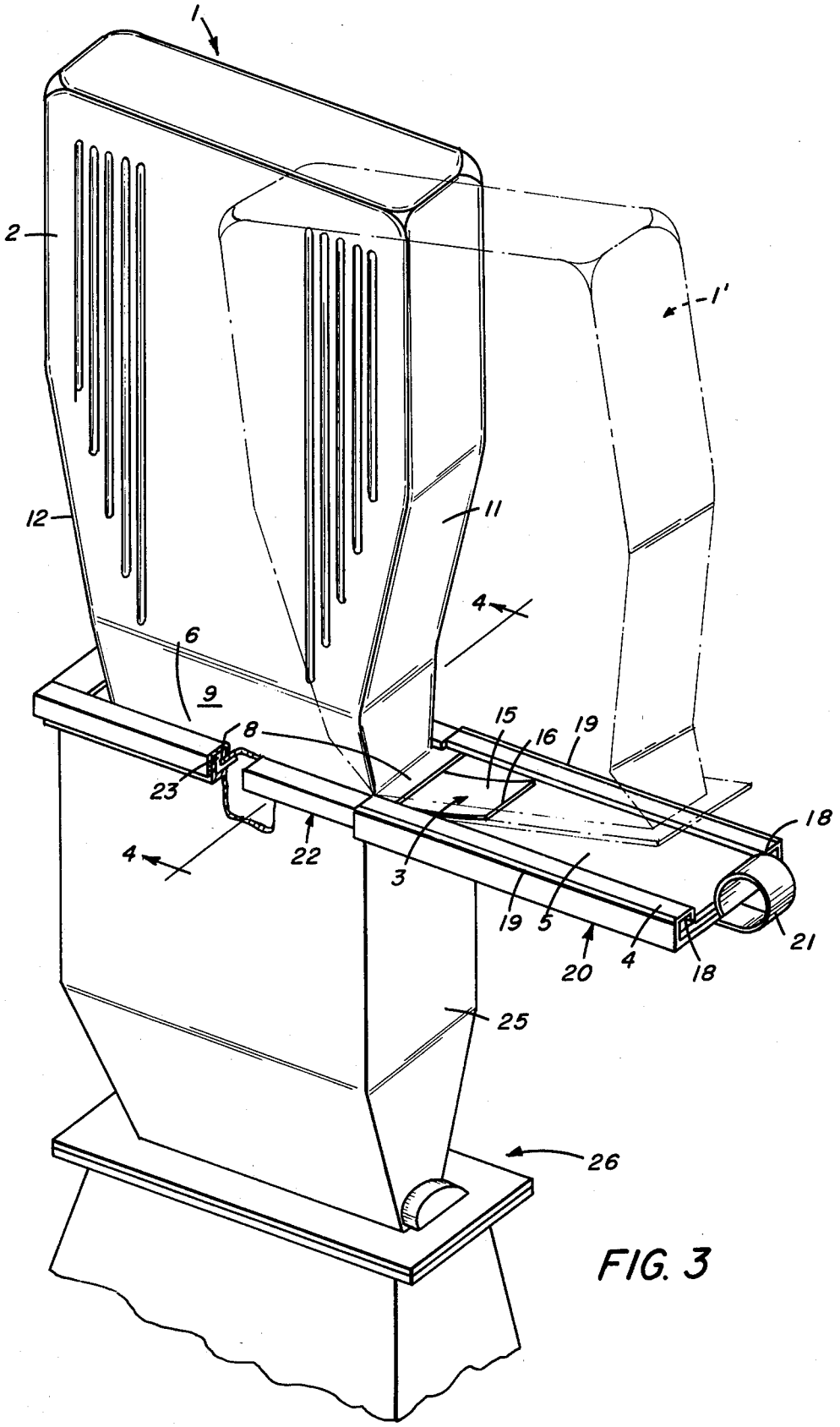
FIG. 3 is a perspective view of the toner container and its receptacle, in accordance with the preferred embodiment of the instant invention, schematically illustrating the manner in which the toner container is operatively positioned on the receptacle.

The housing 2, is shown in FIGS. 1—3, as a blow molded plastic container made, for example, from polyethylene, polypropylene, polyallomer, or a copolymer of these resins. A neck portion 6 of the housing 2 terminates in a rectangular shaped open end 7, peripherally about which is disposed a flat flange member 8. The flange member 8 is integrally formed with the housing 2, and projects from the housing generally in the plane occupied by the open end 7 — see FIGS. 2 and 3. At the neck portion 6, the housing 2 includes two oppositely spaced wall sections 9 and 10 which converge toward the open end 7 — see FIG. 2. Above the neck portion 6, the housing 2 includes two oppositely spaced wall sections 11 and 12 which converge toward the neck portion 6. These converging wall sections 9–12 facilitate gravity flow of the toner powder T from the housing 2, through its open end 7.

The tear strip 3 is constructed, for example, of a polyester film coated with a hot melt adhesive. As shown in FIG. 2, the tear strip 3 includes a sealing piece or member 13 which is secured to the housing flange 8, over the open end 7. By this arrangement, the tear strip 3 serves to seal the open end 7, preventing the toner powder T from leaking out of the housing 2. As is evident from FIG. 2, a surface 14 of the sealing piece 13 is subject to contact by the toner powder T inside the housing 2. In addition to the sealing piece 13, the tear strip 3 includes a pull tab piece or member 15, integrally formed with the sealing piece and folded or doubled back over the sealing piece. The pull tab piece 15 terminates, as realized from FIG. 1, in a free leading end 16 which extends beyond the housing 2 and which, when pulled in the direction generally indicated by the arrow 17 in FIG. 1 and FIG. 5, separates the sealing piece 13 from the flange member 8. This, in effect, opens the housing 2 and enables gravity flow of the toner powder T from the housing, through its open end 7.

The slide cover 4 is constructed of an extruded high-density polyethylene material. As shown in FIG. 2, the slide cover 4 has two oppositely spaced pinch rails 18 which are engageable with the flange member 8, at the neck portion 6 of the housing 2. Engagement of the two pinch rails 18 with the flange member 8, as depicted in FIG. 1, locates the slide cover 4 completely over the open end 7. By this arrangement, the slide cover 4 maintains the pull tab piece 15 of the tear strip 3 folded over its sealing piece 13 and protects the tear strip from any possible puncture during shipping, for example. The sealing piece 13 is peeled off the flange member 8, to open the housing 2, after the slide cover 4 is disengaged from the flange member. The slide cover 4 is disengaged from the flange member 8 by moving the slide cover, with respect to the remainder of the storage unit 1, in the direction generally indicated by the arrow 17 in FIG. 1. After the tear strip 3 is removed from the housing 2 by peeling the sealing piece 13 off the flange member 8, and the toner powder T is drained from the housing, the slide cover 4 is re-engaged with the flange member, over the open end 7, to serve as a dust cover for the empty container.

The wiper-seal 5 is attached to the inside of the slide cover 4, between its pinch rails 18, and extends both the length of the slide cover and the flange member 8 — see FIGS. 1 and 2. The wiper-seal 5 is a resiliently compressible pad constructed, for example, of a low-density polyester urethane foam material. Accordingly, when the slide cover 4 is re-engaged with the flange member 8 of the empty container, the wiper-seal 5 affirmatively seals the open end 7 at the neck portion 6 of the housing 2, by occupying the space previously occupied by the sealing piece 13 of the tear strip 3.

Figure 4:
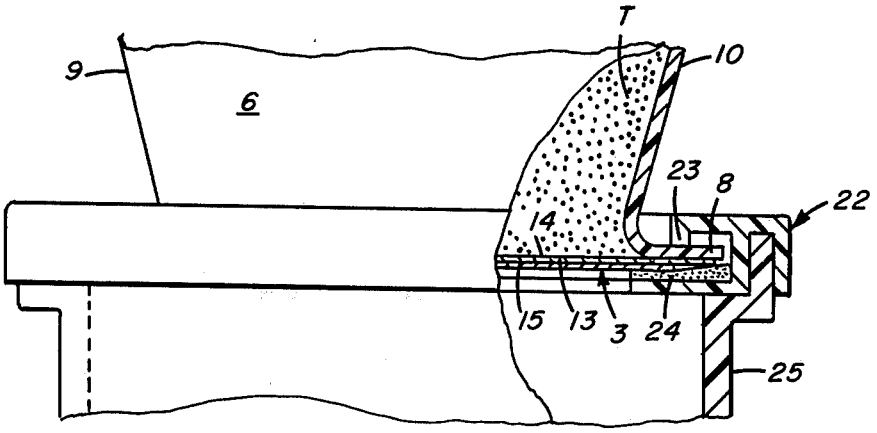
FIG. 4 is an enlarged elevation view, in partial section, of the toner container and the receptacle as viewed along the line 4—4 in FIG. 3.

FIG. 3 illustrates the toner container in two different positions; the first position depicting the toner container in a phantom line version generally designated by the reference numeral 1', and the second position depicting the toner container in a solid line version generally designated by the reference numeral 1. The phantom line version depicts the storage unit without cover 4 only to facilitate clarity and understanding of the invention. In use, the toner container 1' is initially positioned as shown in FIG. 3 and then is pressed downwardly onto a loading fixture 20, locating the slide cover 4 snugly between two oppositely spaced guide rails 19 of the loading fixture. An end spring 21, on the loading fixture 20, facilitates the desired positioning of the slide cover 4 between the two guide rails 19, as shown in FIG. 3. The loading fixture 20 is disposed in an electrophotographic copier, not shown, which is to utilize the toner powder T, inside the toner container 1, for image development. Particular details of the electrophotographic copier may be found, for example, in commonly assigned copending U.S. patent application Ser. No. 481,436, entitled: Synchronizing Control Apparatus for Electrophotographic Apparatus Utilizing Digital Computer, filed June 20, 1974, in the names of W. E. Hunt et al. The two guide rails 19 of the loading fixture 20 securely hold the slide cover 4 in place. This allows the housing 2, containing the toner powder T, to be separated from its cover 4 by moving the housing, generally to the left as viewed in FIG. 3, from the loading fixture 20 to a contiguously located receiving fixture 22. The receiving fixture 22 is located, with the loading fixture 20, in the electrophotographic copier. Two oppositely spaced pinch rails 23 of the receiving fixture 22 engage the housing flange 8, as shown in FIGS. 3 and 4. Inside the receiving fixture 22, several resiliently compressible pads 24 hold the housing flange 8 in abutment with the two pinch rails 23 — see FIG. 4.

When engaged with the receiving fixture 22, as shown in FIG. 3, the housing 2 of the toner storage unit 1 has its open end 7 in communication with the hopper 25 of a dispensing mechanism 26. As the sealing piece 13 of the tear strip 3 is peeled off the flange member 8 of the housing 2, the toner powder T inside the housing drains through its open end 7 into the hopper 25 — see FIG. 5. The dispensing mechanism 26 is disposed in the electrophotographic copier and its function is to dispense metered quantities of the toner powder T (received from the toner container 1) for image development.

Figure 5:
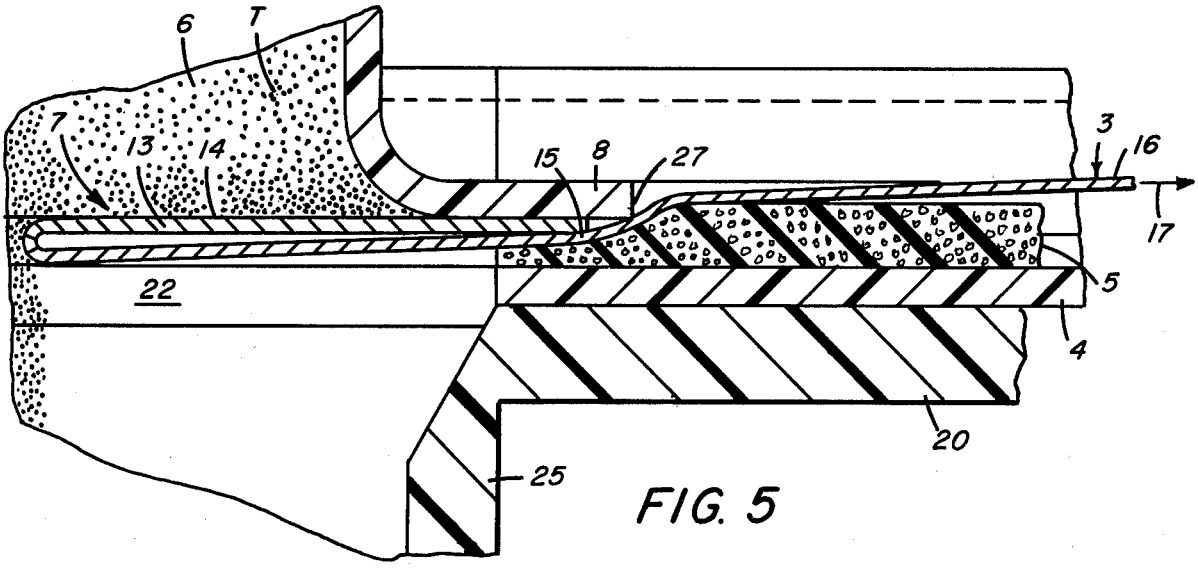
FIG. 5 is an enlarged side elevation view, in partial section, of cooperating portions of the toner container and the receptacle, illustrating the manner in which a tear strip on the toner container is wiped clean of any residual toner during separation of the tear strip from the toner container.

In FIG. 5, as the leading end 16 of the tear strip 3 is pulled by an operator in the direction generally indicated by the arrow 17, the sealing piece 13 of the tear strip is peeled off the flange member 8 of the housing 2. An end 27 of the flange member 8 serves to first hold the pull tab piece 15 of the tear strip 3 in wiping contact with the wiper-seal 5 (on the slide cover 4) and then holds the surface 14 of the sealing piece 13 in wiping contact with the wiper-seal. Accordingly, as the tear strip 3 is separated from the flange member 8, the surface 14 (which is the single portion of the tear strip subject to contact by the toner powder T) is wiped clean of any residual toner powder by the wiper-seal 5. This wiping is accomplished before any portion of surface 14 of the tear strip 3 can be touched by the operator.

After the tear strip 3 is removed from the housing 2 and the toner powder T is drained from the housing into the hopper 25, the slide cover 4 may be re-engaged with the flange member 8 by sliding the housing, generally to the right as viewed in FIG. 3, from the receiving fixture 22 to the loading fixture 20. Then, the toner storage unit 1, with its slide cover 4 serving as a dust cover for the empty container, may be discarded.

In operation, the storage unit 1 with the tear strip 3 and the cover 4 is placed into the loading fixture 20 as shown by the phantom line of FIG. 3. The container 2 is then moved towards the left and the pinch rails 23 slidably engage flanges 8 of the unit 1 and engage the slide cover 4 of the storage unit 11 blocking its movement so that the container 2 and tear strip 3 are moved into the receiving fixture 22. The free end 16 of the tear strip 3 is now pulled and as the strip 3 is removed from the container, the wiper-seal 5 wipes (as seen in FIG. 5.) the moving tear strip of toner. Toner falls into the receiving fixture 22. The empty container 2 is then moved back into the loading fixture 20 where it slidably engages the cover 4 and is positioned such that the wiping-seal affirmatively seals the opening of the container. The empty storage unit 1 is now removed from the loading fixture.

The present invention has been described in detail with particular reference to a preferred embodiment thereof. For example, whenever the term "toner" is used in this Specification or Claims, it will be understood to also include the use of a developer alone. Thus, developer could be stored alone in the storage unit 1. It should be understood that variations and modifications can be effected within the spirit and scope of the instant invention.

We claim:

1. An interface device for (a) a toner container in which is contained a quantity of toner and (b) a toner dispensing mechanism which receives toner from the toner container and dispenses the toner in metered quantities to the image development area in an electrophotographic copier, the toner container having strippable means separable therefrom to effect a toner exit opening in the container and having wiping means removable from the container to a given position for wiping any residual toner from the strippable means as it is separated from the container, said interface device comprising:

means for receiving such a toner, together with the wiping means, and engaging the wiping means in its given position while enabling the toner container to be removed from the wiping means; and means for receiving the toner container, removed from the wiping means, and engaging it in a fixed position which enables toner to drain from the removed container into such a toner dispensing mechanism and which enables the strippable means to move in wiping contact with the wiping means as the strippable means is separated from the removed container.

2. A toner storage unit for use in an electrophotographic apparatus comprising:

a. a container defining a toner receiving chamber and a neck portion of reduced cross section which has an opening in communication with said chamber, said neck portion having at least two spaced external flanges adjacent to said opening;

b. a strippable tear strip member attached to said flanges for closing said opening and having a free end pull portion which when pulled back upon itself results in the separation of said tear strip from said flanges to open said container;

c. a slidable cover having two spaced rails defining opposed internal slots for slidably receiving said flanges so that said cover can be positioned over said opening; and d. a wiper seal slightly wider than the tear strip member disposed in said cover in facing engagement with the tear strip for wiping toner from said tear strip member as said tear strip is separated from said flanges, and for sealing said opening when said cover is moved over said opening with the rails in engagement with said flanges.

3. In combination, a toner storage unit and an interface means of an electrophotographic apparatus for receiving such unit, the improvement wherein:

said unit comprises:

i. a container defining a toner receiving chamber and a neck portion of reduced cross section which has an opening in communication with said chamber, said neck portion having at least two spaced external flanges adjacent to said opening, ii. a strippable tear strip member attached to said flanges for closing said opening and having a free end pull portion which when pulled back upon itself results in the separation of said tear strip from said flanges to open said container, iii. a slidable cover having two spaced rails defining oposed internal slots for slidably receiving said flanges so that said cover can be positioned over said opening, and iv. a wiper seal slightly wider than the tear strip member disposed in said cover in facing engagement with the tear strip for wiping toner from said flanges, and for sealing said opening when said cover is moved over said opening with the rails in engagement with said flanges; and said interface means comprises:

v. a loading fixture having two oppositely spaced guide rails adapted to snugly receive said slidable cover, and vi. a receiving fixture, aligned with said loading fixture, and defining a toner receiving hopper and having two spaced blocking members which define pinch rails for slidably engaging said flanges of said container respectively and for engaging said slidable cover such that said container can be moved in sliding engagement with said pinch rails from said loading fixture to said receiving fixture with said cover remaining in said receiving fixture and positioned so that when said free end is pulled, said wiper seal wipes toner from said tear strip member, and after toner is loaded in the said hopper, said container can be moved back to said loading fixture into slidable engagement with said cover.

* * * * *